US010583317B2

(12) United States Patent
Amyan

(10) Patent No.: US 10,583,317 B2
(45) Date of Patent: Mar. 10, 2020

(54) MULTIPURPOSE PORTABLE GYM EQUIPMENT

(71) Applicant: Avetik Amyan, Brooklyn, NY (US)

(72) Inventor: Avetik Amyan, Brooklyn, NY (US)

( * ) Notice: Subject to any disclaimer, the term of this patent is extended or adjusted under 35 U.S.C. 154(b) by 71 days.

(21) Appl. No.: 15/950,776

(22) Filed: Apr. 11, 2018

(65) Prior Publication Data

US 2018/0296873 A1 Oct. 18, 2018

Related U.S. Application Data

(60) Provisional application No. 62/485,508, filed on Apr. 14, 2017.

(51) Int. Cl.
*A63B 21/072* (2006.01)
*A63B 21/00* (2006.01)

(52) U.S. Cl.
CPC ..... *A63B 21/0722* (2015.10); *A63B 21/0728* (2013.01); *A63B 21/4035* (2015.10); *A63B 2210/50* (2013.01); *A63B 2210/58* (2013.01); *A63B 2225/093* (2013.01)

(58) Field of Classification Search
CPC ..... A63B 21/072; A63B 21/0722; A63B 21/0724; A63B 2210/50; A63B 23/03558
See application file for complete search history.

(56) References Cited

U.S. PATENT DOCUMENTS 3,825,253 A * 7/1974 Speyer ..... A63B 21/0728 482/106
4,900,015 A * 2/1990 Dissinger ..... A63B 23/03533 482/121
5,957,818 A * 9/1999 Betournay ..... A63B 21/065 482/105
6,663,542 B1 * 12/2003 Trabbic ..... A63B 21/0724 482/106
8,574,136 B1 * 11/2013 Burstrom ..... A63B 69/0057 482/108
8,992,395 B2 * 3/2015 Orakwusi ..... A63B 21/1636 482/106

(Continued)

FOREIGN PATENT DOCUMENTS

CN 203108078 U * 8/2013

OTHER PUBLICATIONS

English translation of CN 203108078 U (Year: 2013).*

*Primary Examiner* — Charlie Y Peng
(74) *Attorney, Agent, or Firm* — John J. Bamert, Esq.; Lowe Graham Jones, PLLC

(57) ABSTRACT

Embodiments are directed to an exercise equipment apparatus. The apparatus may comprise a lateral crossbeam, a first upward support member, and a first longitudinal support member. The first upward support member may have a proximal end portion and a distal end portion. The first upward support member may couple to the crossbeam. The first longitudinal support member may have two end portions. The first longitudinal support member may separably couple to the distal end portion of the first upward support member. Each of the two end portions of the first longitudinal support member may be sized and dimensioned to receive one or more weight plates and facilitate use of the first longitudinal support member as a weight-lifting bar when separated from the distal end portion of the first upward support member.

20 Claims, 10 Drawing Sheets

(56) References Cited

U.S. PATENT DOCUMENTS

| | | | | |
|---|---|---|---|---|
| 2014/0094347 | A1* | 4/2014 | Orakwusi | A63B 21/1636<br>482/38 |
| 2018/0126211 | A1* | 5/2018 | Chen | A63B 21/4033 |

* cited by examiner

MULTIPURPOSE PORTABLE GYM EQUIPMENT

CROSS-REFERENCE TO RELATED APPLICATIONS

This application claims the benefit of U.S. Provisional Application No. 62/485,508, entitled "Multipurpose portable gym equipment," filed 14 Apr. 2017, which is incorporated herein by reference in its entirety.

FIELD OF THE INVENTION

This application relates to gym equipment and, more particularly, yet not exclusively, collapsible multipurpose gym equipment.

BACKGROUND OF THE INVENTION

To engage each of a user's major muscle groups, the user typically employs a variety of pieces of workout equipment. Typical workout equipment often includes free weights in combination with other structures, such as pull-up bars, that are either fixedly coupled to buildings or integrated in large, heavy workout machinery. The quantity and size of the pieces of workout equipment precludes practical portability in normal activities, such as business traveling from hotel to hotel. Workout equipment that is not fixedly coupled to buildings or integrated in large, heavy workout machinery typically fails to permit the user to exercise each of the user's major muscle groups, lacks the stability required to allow the user to confidently workout, is challenging to use, and is expensive. Thus, it is with regard to these considerations and others that the present invention has been made.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Preferred Embodiment, which is to be read in association with the accompanying drawings, wherein.

SUMMARY OF THE INVENTION

Figure 1:
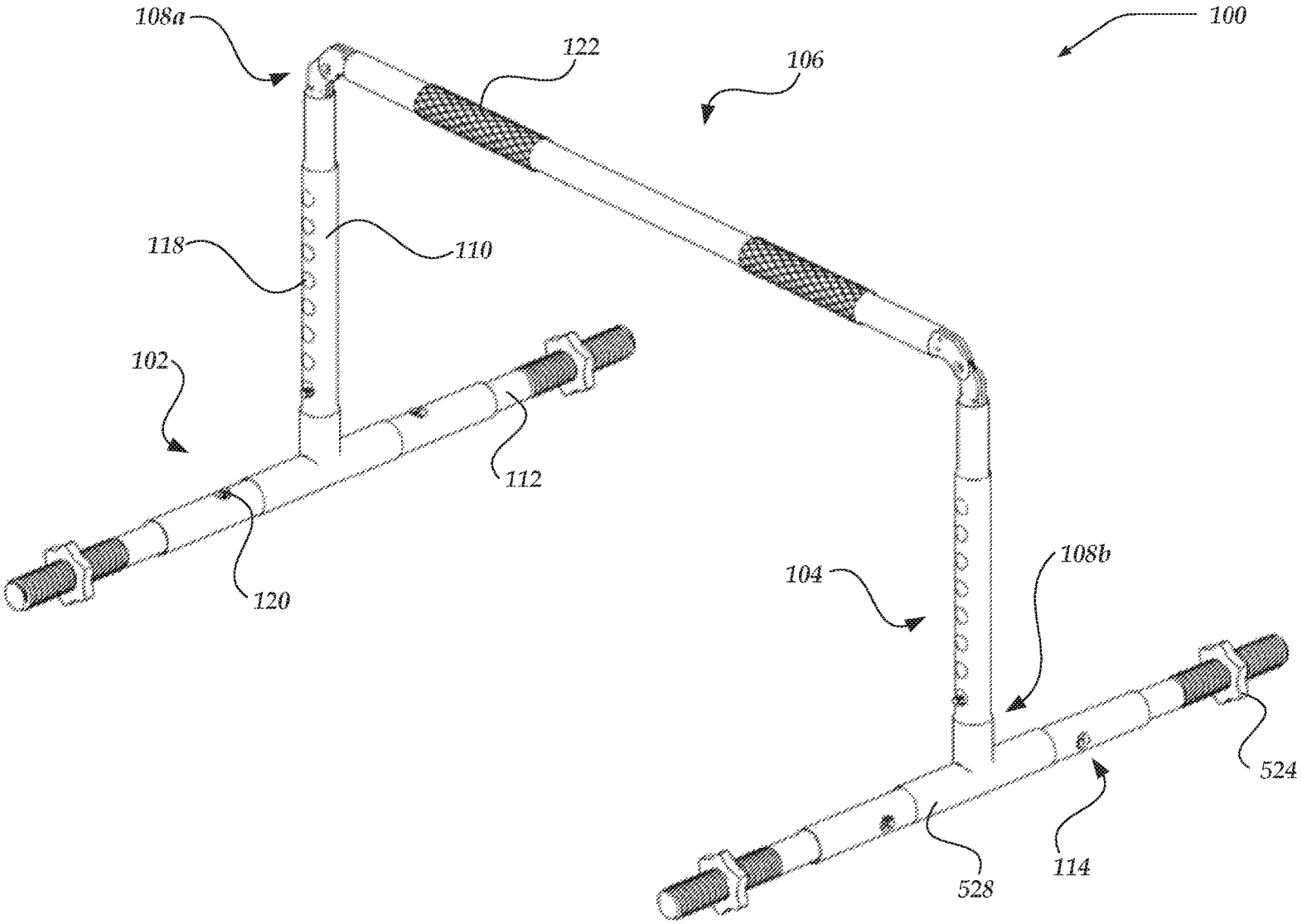
FIG. 1 shows an isometric view of an example exercise apparatus having upward and longitudinal tubular support members and a lateral tubular crossbeam, with the apparatus in a deployed configuration and each of the support members in a shortened configuration.

The following briefly describes example embodiments of the invention in order to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to an exercise equipment apparatus. In one or more of the various embodiments, the exercise equipment apparatus may include a latera crossbeam, a first upward support member, and a first longitudinal support member. In some of the various embodiments, the first upward support member may have a proximal end portion and a distal end portion. In some embodiments, the first upward support member may couple to the crossbeam. In some embodiments, the first longitudinal support member may have two end portions. In some embodiments, the first longitudinal support member may separably couple to the distal end portion of the first upward support member. In some embodiments, each of the two end portions of the first longitudinal support member may be sized and dimensioned to receive one or more weight plates and facilitate use of the first longitudinal support member as a weight-lifting bar when separated from the distal end portion of the first upward support member.

In one or more of the various embodiments, the apparatus may further include two collars coupling to respective ones of the end portions of the first longitudinal support member and securing the one or more weight plates to the first longitudinal support member.

In one or more of the various embodiments, the two end portions of the first longitudinal support member may be threaded and may facilitate receiving one or more collars that secure the one or more weight plates to the first longitudinal support member.

In one or more of the various embodiments, the first longitudinal support member may have a middle portion disposed between the two end portions of the first longitudinal support member. In some of the various embodiments, the middle portion of the first longitudinal support member may abut one or more of the two end portions of the first longitudinal support member. In some embodiments, the one or more of the two end portions of the first longitudinal support member may have a first outer diameter. In some embodiments, the middle portion of the first longitudinal support member may have a second outer diameter that is larger than the first outer diameter of the one or more of the two end portions of the first longitudinal support member and that may facilitate securing the one or more weight plates between the middle portion and one or more collars received on the one or more of the two end portions of the first longitudinal support member.

In one or more of the various embodiments, the first longitudinal support member may have one or more handgrips.

In one or more of the various embodiments, the first longitudinal support member may have one or more telescoping tubes and one or more extension locks that, in an unlocked configuration, permit extending or shortening the one or more telescoping tubes and that, in a locked configuration, prevent extending or shortening the one or more telescoping tubes.

In one or more of the various embodiments, the first longitudinal support member may have one or more telescoping tubes. In some of the various embodiments, each telescoping tube may have an inner tube and an outer tube. In some embodiments, the outer tube may at least partially house the inner tube. In some embodiments, the inner tube may have one or more handgrips.

In one or more of the various embodiments, the first upward support member may have one or more telescoping tubes and one or more extension locks that, in an unlocked configuration, permit extending or shortening the one or more telescoping tubes and that, in a locked configuration, prevent extending or shortening the one or more telescoping tubes.

In one or more of the various embodiments, the first upward support member may hingeably couple to the crossbeam and may facilitate transitioning the exercise equipment apparatus between a deployed configuration and a collapsed configuration. In some of the various embodiments, the exercise equipment apparatus may have a smaller form factor in the collapsed configuration.

In one or more of the various embodiments, the lateral crossbeam may have one or more handgrips.

In one or more of the various embodiments, the apparatus may further include a second upward support member and a second longitudinal support member. In some of the various embodiments, the second upward support member may have a proximal end portion and a distal end portion. In some embodiments, the crossbeam may have a first end portion and a second end portion. In some embodiments, the first upward support member may couple to the first end portion of the crossbeam. In some embodiments, the second upward support member may couple to the second end portion of the crossbeam. In some embodiments, the second longitudinal support member may have two end portions. In some embodiments, the second longitudinal support member may separably couple to the distal end portion of the second upward support member. In some embodiments, each of the two end portions of the second longitudinal support member may be sized and dimensioned to receive one or more weight plates and may facilitate use of the second longitudinal support member as a weight-lifting bar when separated from the distal end portion of the second upward support member.

Also briefly stated, various embodiments are directed to a method of exercising. In one or more of the various embodiments, the exercise equipment apparatus may be provided. In some of the various embodiments, the first longitudinal support member may be coupled to the distal end portion of the first upward support member. In some embodiments, the crossbeam may be gripped with the first longitudinal support member coupled to the distal end portion of the first upward support member. In some embodiments, the gripped crossbeam may be repeatedly pulled or pushed to repeatedly move a human body toward or away from the crossbeam with the first longitudinal support member coupled to the distal end portion of the first upward support member. In some embodiments, the first longitudinal support member may be separated from the distal end portion of the first upward support member. In some embodiments, the one or more weight plates may be coupled to the first longitudinal support member with the first longitudinal support member separated from the distal end portion of the first upward support member. In some embodiments, the first longitudinal support member may be gripped with the first longitudinal support member separated from the distal end portion of the first upward support member and with the one or more weight plates coupled to the first longitudinal support member. In some embodiments, the gripped first longitudinal support member may be repeatedly employed to perform one or more weight-lifting exercises with the first longitudinal support member separated from the distal end portion of the first upward support member and with the one or more weight plates coupled to the first longitudinal support member.

In one or more of the various embodiments, the exercise equipment apparatus may further include one or more collars that may be sized and dimensioned to be received on one or more of the two end portions of the first longitudinal support member. In some of the various embodiments, the first longitudinal support member may have a middle portion disposed between the two end portions of the first longitudinal support member. In some embodiments, the middle portion of the first longitudinal support member may abut the one or more of the two end portions of the first longitudinal support member. In some embodiments, the one or more of the two end portions of the first longitudinal support member may have a first outer diameter. In some embodiments, the middle portion of the first longitudinal support member may have a second outer diameter that is larger than the first outer diameter of the one or more of the two end portions of the first longitudinal support member and that facilitates securing the one or more weight plates between the middle portion and the one or more collars received on the one or more of the two end portions of the first longitudinal support member. In some embodiments, the one or more weight plates may be slid onto the one or more of the two end portions of the first longitudinal support member. In some embodiments, the one or more collars may be coupled to the one or more of the two end portions of the first longitudinal support member.

In one or more of the various embodiments, the first longitudinal support member may have one or more telescoping tubes and one or more extension locks that, in an unlocked configuration, permit extending or shortening the one or more telescoping tubes and that, in a locked configuration, prevent extending or shortening the one or more telescoping tubes. In some of the various embodiments, repeatedly employing the gripped first longitudinal support member to perform the one or more weight-lifting exercises may include repeatedly employing the gripped first longitudinal support member to perform the one or more weight-lifting exercises with the first longitudinal support member separated from the distal end portion of the first upward support member, with the one or more weight plates coupled to the first longitudinal support member, and with the one or more telescoping tubes fully extended.

In one or more of the various embodiments, the first longitudinal support member may have one or more telescoping tubes. In some of the various embodiments, each telescoping tube may have an inner tube and an outer tube. In some embodiments, the outer tube may at least partially house the inner tube. In some embodiments, the inner tube may have one or more handgrips. In some embodiments, gripping the first longitudinal support member may include fully extending each telescoping tube to expose one or more portions of each handgrip and gripping the first longitudinal support member with the first longitudinal support member separated from the distal end portion of the first upward support member, with the one or more weight plates coupled to the first longitudinal support member, and with each telescoping tube fully extended.

In one or more of the various embodiments, the first upward support member may have one or more telescoping tubes and one or more extension locks that, in an unlocked configuration, permit extending or shortening the one or more telescoping tubes and that, in a locked configuration, prevent extending or shortening the one or more telescoping tubes. In some of the various embodiments, repeatedly pulling or pushing on the gripped crossbeam to repeatedly move the human body toward or away from the crossbeam may include repeatedly pulling or pushing on the gripped crossbeam to repeatedly move the human body toward or away from the crossbeam with the first longitudinal support member coupled to the distal end portion of the first upward support member and with the one or more telescoping tubes fully extended.

In one or more of the various embodiments, the first upward support member may hingeably couple to the crossbeam and may facilitate transitioning the exercise equipment apparatus between a deployed configuration and a collapsed configuration. In some of the various embodiments, the exercise equipment apparatus may have a smaller form factor in the collapsed configuration. In some embodiments, repeatedly pulling or pushing on the gripped crossbeam to repeatedly move the human body toward or away from the crossbeam may include transitioning the exercise equipment apparatus from the collapsed configuration to the deployed configuration and repeatedly pulling or pushing on the gripped crossbeam to repeatedly move the human body toward or away from the crossbeam with the first longitudinal support member coupled to the distal end portion of the first upward support member and with the exercise equipment apparatus in the deployed configuration.

DETAILED DESCRIPTION OF THE PREFERRED EMBODIMENT

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

The term "portable" as used herein refers to the size and weight of an element being sufficiently small that the average adult human can carry the element with a single hand without external assistance, such as assistance of a tool, machinery, or another human.

FIG. 1 shows an isometric view of example exercise apparatus 100 in a deployed configuration. In one or more of the various embodiments, apparatus 100 may have one or more longitudinal tubular support members 102. In some of the various embodiments, one or more upward tubular support members 104 may extend upward from one or more longitudinal support members 102. In some embodiments, one or more lateral tubular crossbeams 106 may extend from one or more upward support members 104 to one or more other upward support members 104. In some embodiments, each upward support member 104 may have one or more proximal end portions and one or more distal end portions. In some embodiments, one or more distal end portions of one or more upward support members 104 may separably or hingeably couple to one or more middle portions of one or more longitudinal support members 102. In some embodiments, one or more lateral crossbeams 106 may separably or hingeably couple to one or more proximal end portions of one or more upward support members 104. In some embodiments, one or more separable or hingable couplings 108 may facilitate collapsing apparatus 100 from the deployed configuration to a collapsed configuration (see, for example, FIG. 10) or deploying apparatus 100 from the collapsed configuration to the deployed configuration to provide a highly portable system, as well as increase the number of different exercises that may be performed with apparatus 100. In some embodiments, apparatus 100 in the deployed configuration or the collapsed configuration may be portable to facilitate relatively easy transport or storage of apparatus 100.

Figure 3:
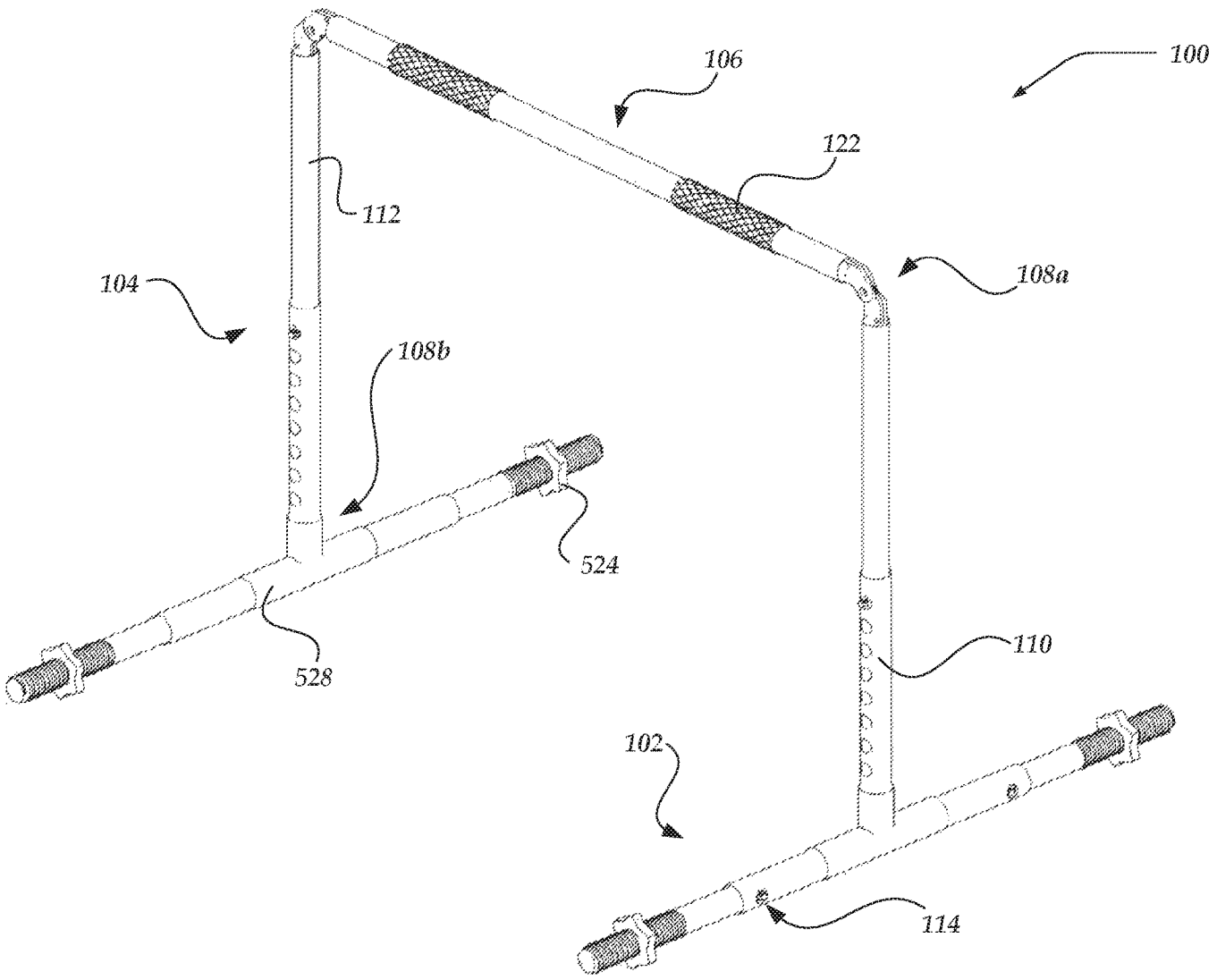
FIG. 3 shows an isometric view of the exercise apparatus of FIG. 1 with the upward support members in the extended configuration.
Figure 4:
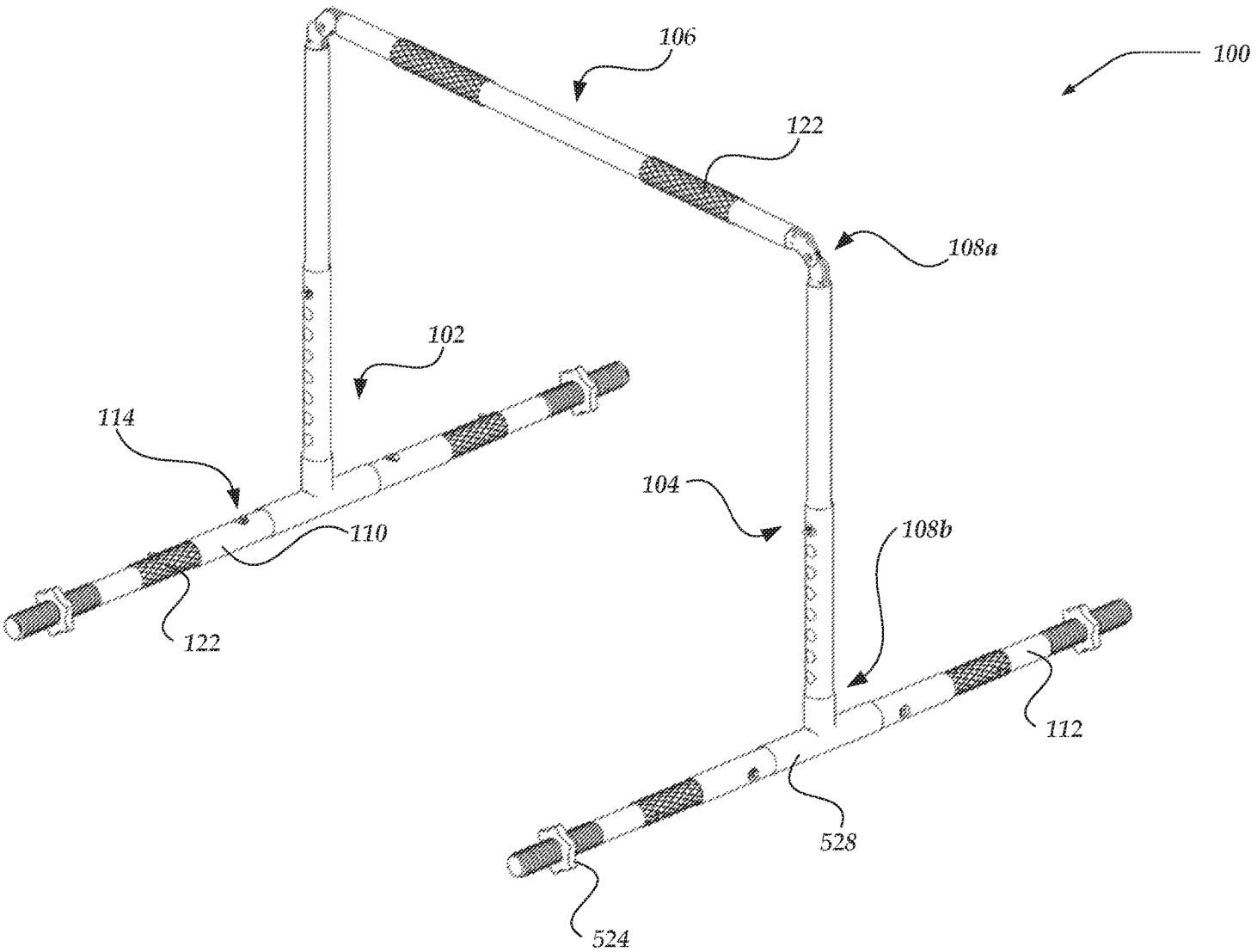
FIG. 4 illustrates an isometric view of the exercise apparatus of FIG. 1 with the upward and longitudinal support members in an extended configuration.
Figure 5:
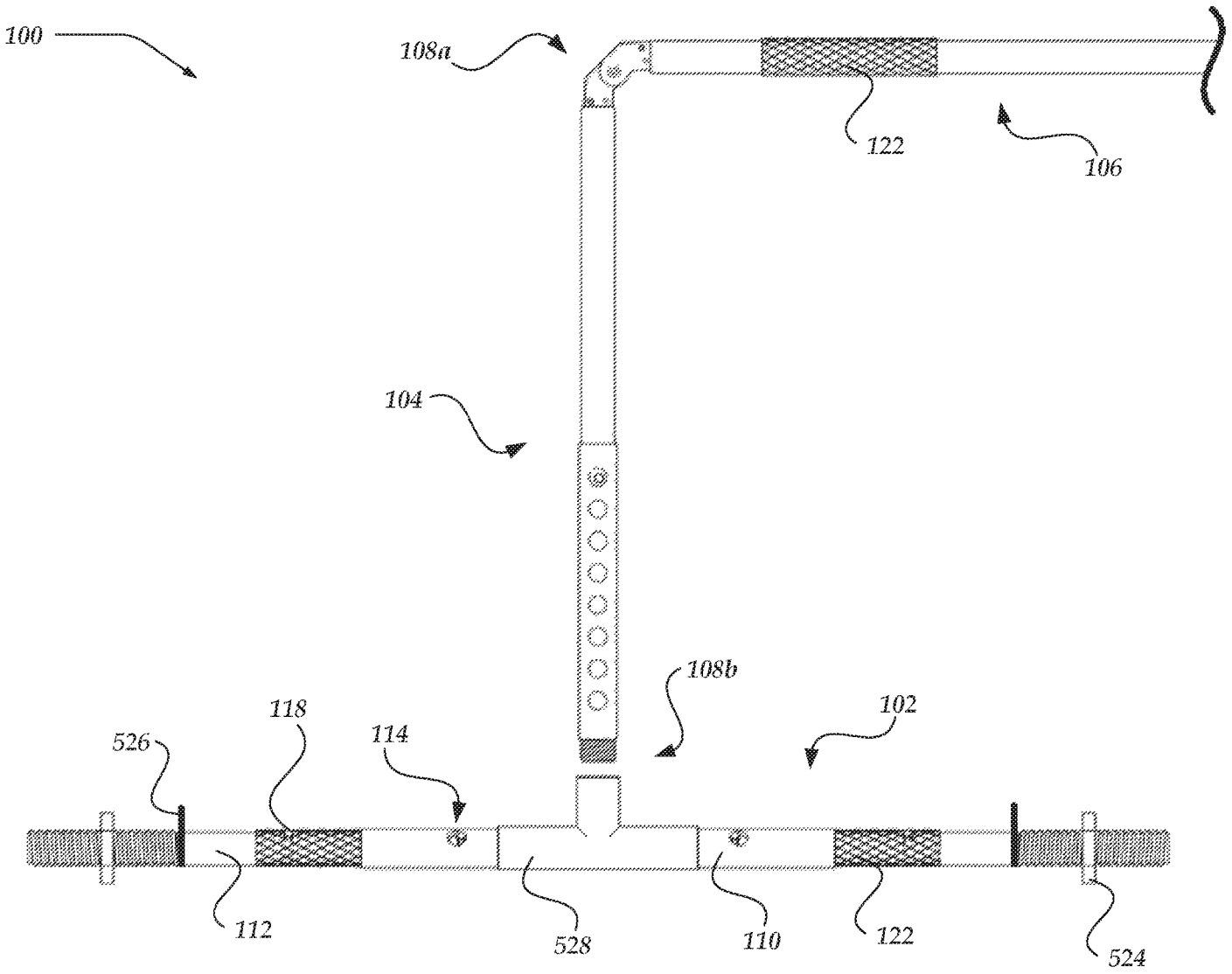
FIG. 5 shows an isometric view of a portion of the exercise apparatus of FIG. 1 with one of the longitudinal support members detached from one of the upward support members.

In one or more of the various embodiments, one or more longitudinal support members 102, upward support members 104, or lateral crossbeams 106 may include one or more telescoping tubes, thereby facilitating changing the form factor of apparatus 100 between an extended configuration (see, for example, FIG. 4) and a shortened configuration (see, for example, FIG. 1) to increase portability of the system, as well as increase the number of different exercises that may be performed with apparatus 100. In some of the various embodiments, each telescoping tube may include one or more outer tubes 110, inner tubes 112, and one or more extension locks 114, thereby facilitating securing each telescoping tube in one or more of the shortened configuration or the extended configuration to provide increased rigidity of apparatus 100 in use. In some embodiments, each outer tube 110 may house one or more portions of one or more inner tubes 112, and each inner tube 112 may be slidably expandable from within one or more outer tubes 110 into the extended configuration (for example, FIGS. 4, 5, and 7 show longitudinal support members 102 in the extended configuration, and FIGS. 2-5 and 7 show upward support members 104 in the extended configuration) and may be slidably collapsible back into one or more outer tubes 110 into the shortened configuration (for example, FIGS. 1-3, 6, 8, 9, and 10 show longitudinal support members 102 in the shortened configuration, and FIGS. 1, 6, 8, and 10 show upward support members 104 in the shortened configuration).

Figure 2:
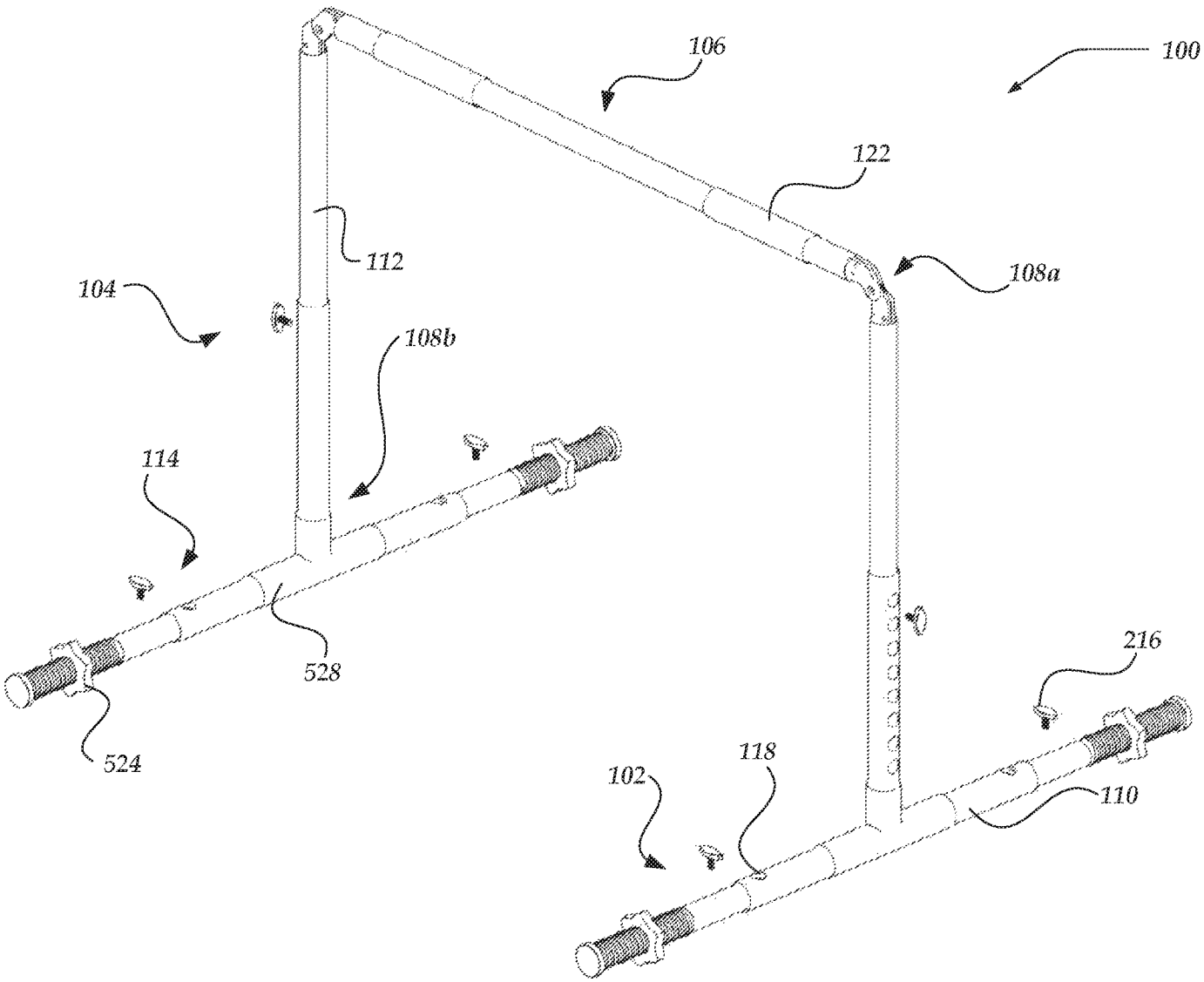
FIG. 2 illustrates an isometric view of the exercise apparatus of FIG. 1 with several pins removed from corresponding support members to demonstrate an example method of transitioning the support members between the shortened configuration and an extended configuration.

In one or more of the various embodiments, each extension lock 114 may be transitioned between a locked configuration (for example, FIGS. 1 and 3-10) and an unlocked configuration (for example, FIG. 2). In some of the various embodiments, each extension lock 114 in the locked configuration may prevent an associated telescoping tube from transitioning between the shortened configuration and the extended configuration. In some embodiments, each extension lock 114 in the unlocked configuration may facilitate transitioning an associated telescoping tube between the shortened configuration and the expanded configuration. In some embodiments, one or more locks 114 may include one or more detents, protrusions in one or more outer tubes 110 or inner tubes 112 and corresponding recessed tracks in the other of one or more outer tubes 110 or inner tubes 112, pins 216 (see, for example, FIG. 2) and corresponding receiving holes 118 in one or more associated outer tubes 110 or inner tubes 112, locking push buttons 120 and corresponding receiving holes 118 in one or more associated outer tubes 110 or inner tubes 112, or others. In some embodiments, rotating one or more inner tubes 112 relative to one or more associated outer tubes 110 may transition one or more associated locks 114 between the locked configuration and the unlocked configuration. In some embodiments, pulling one or more pins out of or inserting the one or more pins into one or more corresponding receiving holes in one or more associated outer tubes 110 or inner tubes 112 may transition one or more associated locks 114 between the locked configuration and the unlocked configuration. In some embodiments, pressing one or more push buttons 120 into one or more receiving holes 118 or releasing one or more push buttons 120 to extend through one or more receiving holes 118 may transition one or more associated locks 114 between the locked configuration and the unlocked configuration.

In one or more of the various embodiments, one or more telescoping tubes, such as upward support members 104, may have two or more lockable positions. In some of the various embodiments, two, three, four, five, six, seven, eight, or more lockable positions may be defined by as many receiving holes 118 for one or more locking push buttons or pins. In some embodiments, increasing the number of lockable positions increases the number of different exercises or variances of an exercise that may be performed using apparatus 100 or the range of user heights or body types that are supported by apparatus 100.

In one or more of the various embodiments, crossbeam 106 may have one or more handgrips 122 that facilitate improving the quality or comfort of the user's grip, at least in comparison to crossbeam 106 without handgrips 122. In some of the various embodiments, one or more handgrips 122 may include knurled engravings in crossbeam 106 or cushioning or non-slip materials that at least partially surround crossbeam 106, such as foam, rubber, or others (for example, urethane foam, urethane rubber, or others).

In one or more of the various embodiments, one or more longitudinal support members 102, upward support members 104, or lateral crossbeams 106 may include solid or hollow tubes that include one or more plastics, metals (for example, steel, aluminum, or others), fiberglass, or others. In some of the various embodiments, one or more longitudinal support members 102, upward support members 104, or lateral crossbeams 106 may include straight or curved tubes that have circular, polygonal, or other-shaped cross-sections. In some embodiments, one or more longitudinal support members 102 or lateral crossbeams 106 may have one or more curves, such as the curves in a trap bar, cambered bar, swiss bar, curl bar, or others. In some embodiments, one or more longitudinal support members 102 or lateral crossbeams 106 may include one or more weight-lifting bars, such as one or more trap bars, cambered bars, swiss bars, curl bars, dumbbells, barbells, or others. In some embodiments, one or more longitudinal support members 102 may have one or more curves that facilitate increasing stability of apparatus 100 in use, such as U-curves, S-curves, or others along the longitudinal length of one or more longitudinal support members 102 with the curves being in a plane that is parallel to the ground.

FIG. 2 illustrates an isometric view of exercise apparatus 100 with several pins 216 removed from corresponding receiving holes 118 in longitudinal support members 102 and upward support members 104 to demonstrate an example of transitioning the support members between the shortened configuration and the extended configuration. In one or more of the various embodiments, with one or more pins 216 removed (or one or more push buttons 120 are in a depressed configuration), one or more inner tubes 112 may be pulled at least partially out of one or more outer tubes 110 to extend and increase the length of one or more telescoping tubular members, such as one or more longitudinal support members 102 or upward support members 104. For example, FIG. 3 shows an isometric view of exercise apparatus 100 with upward support members 104 in the fully extended configuration, in which one or more push buttons 120 are in a locked configuration through topmost receiving holes 118.

FIG. 4 illustrates an isometric view of apparatus 100 with longitudinal support members 102 and upward support members 104 in the extended configuration. In one or more of the various embodiments, one or more longitudinal support members 102 may have one or more handgrips 122 that facilitate improving the quality or comfort of the user's grip, at least in comparison to one or more longitudinal support members 102 without handgrips 122. In some of the various embodiments, one or more handgrips 122 may be disposed in one or more inner tubes 112 of one or more longitudinal support members 102, thereby facilitating protecting the one or more handgrips 122 in the shortened configuration when handgrips 122 are not in use. In some embodiments, one or more handgrips 122 may include engravings in crossbeam 106 or cushioning or non-slip materials that at least partially surround crossbeam 106, such as foam, rubber, or others (for example, urethane foam, urethane rubber, or others).

FIG. 5 shows an isometric view of a portion of exercise apparatus 100 with one longitudinal support member 102 detached from one upward support member 104. In one or more of the various embodiments, one or more collars 524 may be separably coupled to one or more end portions of one or more longitudinal support members 102 to facilitate securing one or more weight plates to the one or more end portions. In some of the various embodiments, one or more collars 524 may include one or more Quicklee collars, spin-lock collars, clamp collars, screw-on collars, pressure collars, or others. In some embodiments, the one or more end portions of one or more longitudinal support members 102 may have one or more threads to facilitate separably coupling one or more collars 524 to the one or more end portions. In some embodiments, the one or more end portions may have one or more roller bearing housings or sleeves. In some embodiments, one or more collars 524 may include one or more plastics, rubbers, metals, or others. In some embodiments, one or more collars 524 may be chrome plated.

In one or more of the various embodiments, the one or more end portions of one or more longitudinal support members 102 may have an outer diameter that is smaller than an inner diameter of one or more holes in one or more weight plates, thereby facilitating sliding the one or more weight plates onto the one or more end portions of one or more longitudinal support members 102. In some of the various embodiments, one or more middle portions of one or more longitudinal support members 102 may have an outer diameter that is larger than the inner diameter of one or more holes in one or more weight plates and that is larger than the outer diameter of the one or more end portions of one or more longitudinal support members 102, thereby facilitating separably securing one or more weight plates between the one or more middle portions and one or more collars 524.

In one or more of the various embodiments, one or more blocker flanges 526 may radially extend from one or more longitudinal support members 102 at a location that is inward from the one or more end portions, thereby facilitating separably securing one or more weight plates between the one or more blocker flanges 526 and one or more collars 524. In some of the various embodiments, one or more blocker flanges 526 may form a circular shape that may extend outward by an equal distance along the entire outer circumference of one or more longitudinal support members 102. In some embodiments, one or more blocker flanges 526 may extend outward by a shorter distance (or not at all) from a bottom portion of one or more longitudinal support members 102, thereby facilitating preventing one or more blocker flanges 526 from disrupting stability of apparatus 100 when one or more longitudinal support members 102 are in the deployed configuration. In some embodiments, one or more blocker flanges 526 may have one or more horizontal bottom surfaces that are parallel to the floor when apparatus 100 is at rest on the ground (for example, a semi-circular shape, rectangular shape, or others), thereby facilitating increasing the stability of apparatus 100.

In one or more of the various embodiments, one or more receiving holes 118 may be disposed in one or more handgrips 122 in one or more longitudinal support members 102 to facilitate securing one or more inner tubes 112 in the shortened configuration. In some of the various embodiments, one or more separable couplings 108*b* may include one or more pipe clamps (for example, one or more snap pipe clamps that surround one or more longitudinal support members 102 or others), saddle tees, pipe clip Ts, T-pipes 528, or others. In some embodiments, one or more T-pipes 528 may have one or more top portions that may couple to one or more distal end portions of one or more upward support members 104 by Snap-fit, interference fit, threaded coupling, or others. In some embodiments, one or more T-pipes 528 may have male or female threads at one or more top portions to facilitate threadably coupling to one or more male or female threaded distal end portions of one or more upward support members 104. In some embodiments, one or more T-pipes 528 may be coupled to one or more telescoping tubes of one or more longitudinal support members 102. In some embodiments, one or more outer tubes 110 may freely rotate within one or more T-pipes 528. In some embodiments, one or more outer tubes 110 may be rotationally fixed relative to one or more T-pipes 528. In some embodiments, one or more T-pipes 528 may include or be integral to one or more outer tubes 110. In some embodiments, one or more separable couplings In one or more of the various embodiments, one or more hingable couplings 108*a* may include one or more hinges with one or more detents or other locking mechanisms (for example, one or more pins 216 and one or more receiving holes 118, push buttons 120 and one or more receiving holes 118, or others) that facilitate maintaining the orientation of each crossbeam 106 relative to each hingeably coupled upward support member 104, absent intentional human interaction with the one or more detents or other locking mechanisms, at least when in the deployed configuration. In some of the various embodiments, a hinge may include a locking pin and two or more hinge plates that are hingeably coupled to each other, with one or more of the hinge plates including a receiving hole into which the locking pin may be inserted to lock the hinge plates relative to each other and from which the locking pin may be removed to permit swiveling the hinge plates relative to each other.

In one or more of the various embodiments, one or more end portions of one or more hingable couplings 108*a* may be integral, separably coupled, or fixedly coupled to one or more crossbeams 106, upward support members 104, or longitudinal support members 102. In some of the various embodiments, one or more end portions of one or more hingable couplings 108*a* may be sized and dimensioned to correspond to the inner walls of one or more end portions of one or more crossbeams 106, upward support members 104, or longitudinal support members 102 to facilitate receiving the one or more end portions of one or more hingable couplings 108*a* in the one or more end portions of one or more crossbeams 106, upward support members 104, or longitudinal support members 102. In some embodiments, the one or more end portions of one or more hingable couplings 108*a* may couple to the one or more end portions of one or more crossbeams 106, upward support members 104, or longitudinal support members 102 with one or more of Snap-fit, interference fit, threaded coupling, or others. In some embodiments, one or more pins 216 or push buttons 120, in conjunction with one or more corresponding receiving holes 118, may separably secure the one or more end portions of one or more hingable couplings 108*a* to the one or more end portions of one or more crossbeams 106, upward support members 104, or longitudinal support members 102.

Figure 6:
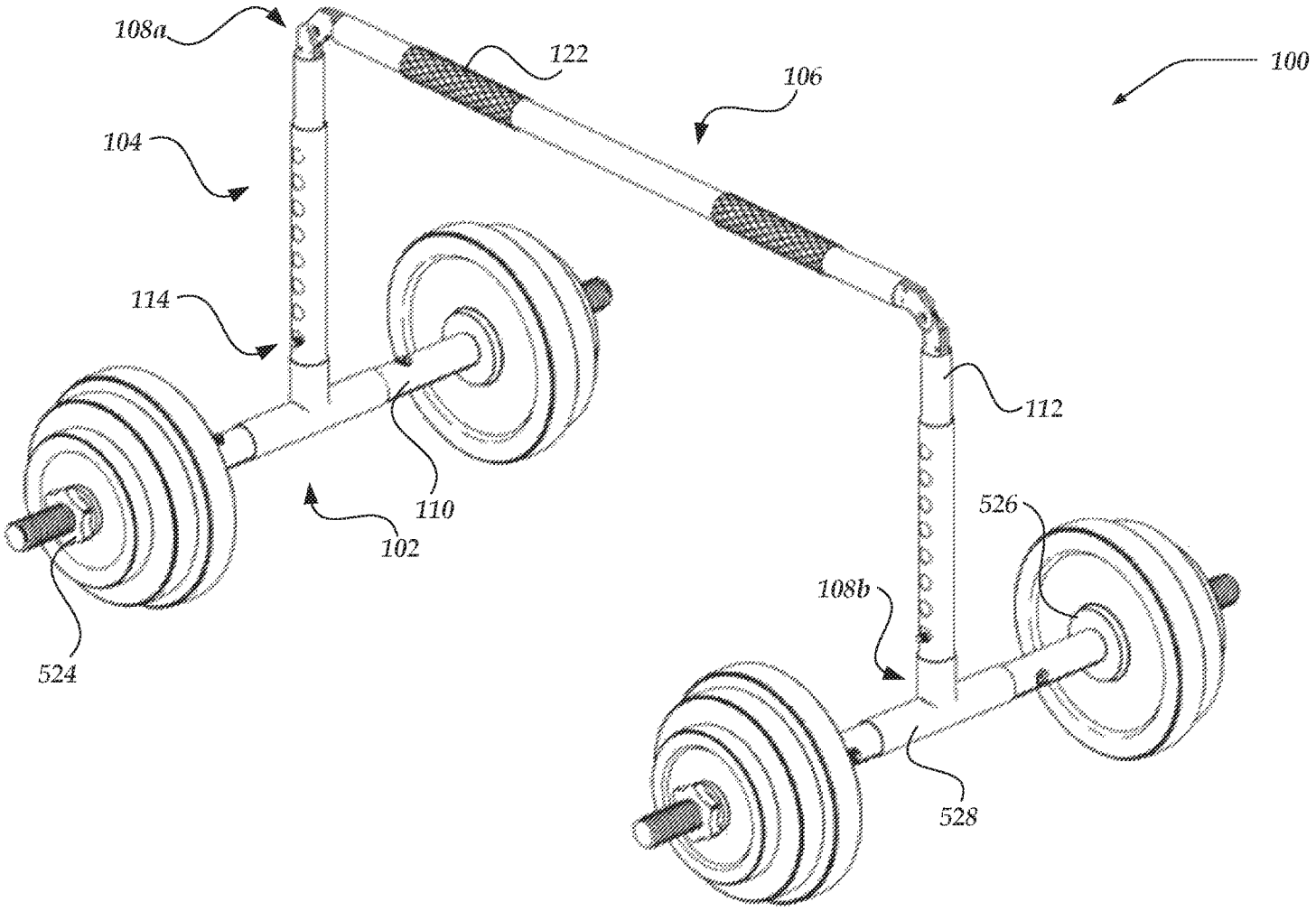
FIG. 6 illustrates an isometric view of the exercise apparatus of FIG. 1 with weight plates separably coupled to the longitudinal support members.
Figure 7:
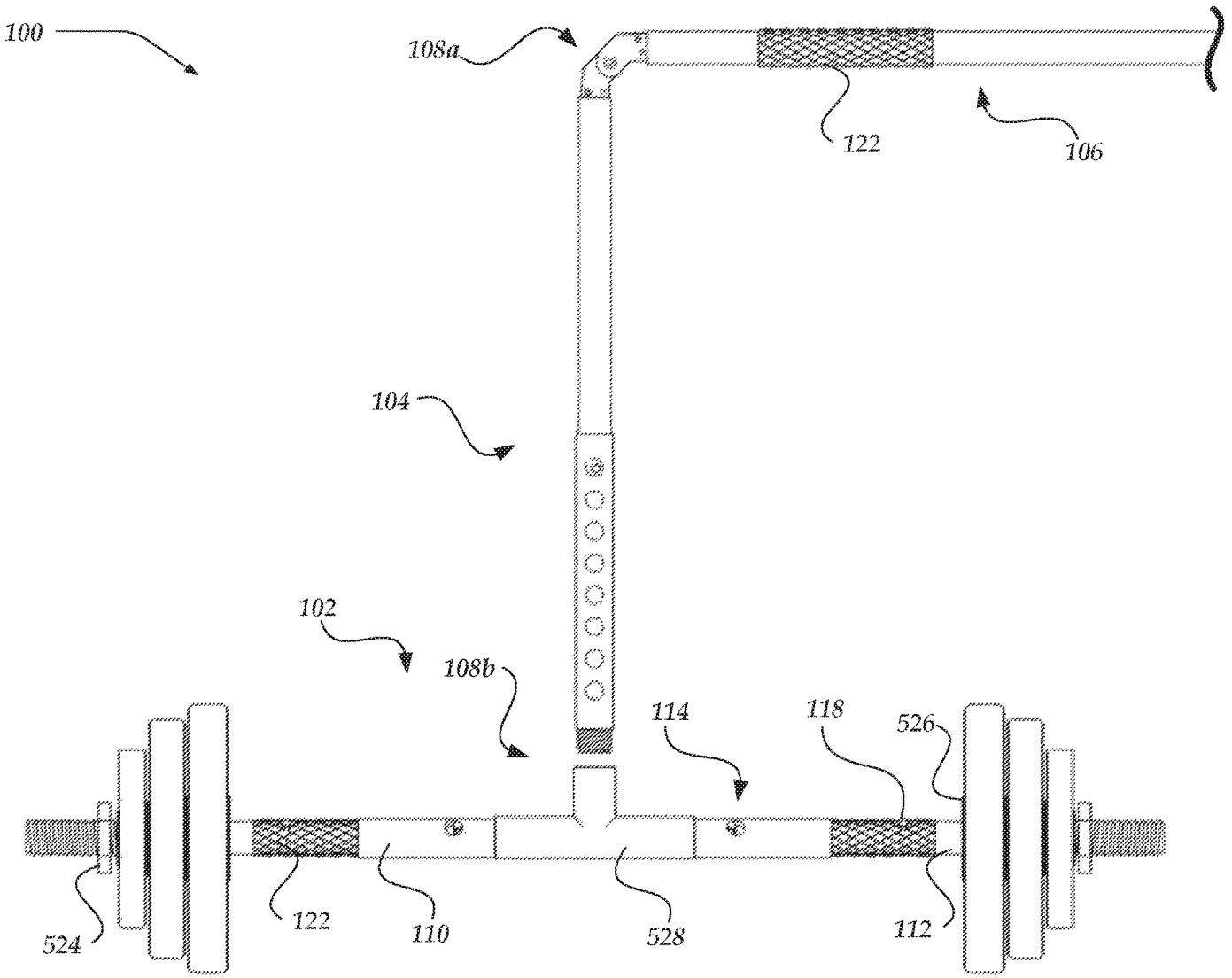
FIG. 7 shows an isometric view of a portion of the exercise apparatus of FIG. 1 with weight plates separably coupled to one of the longitudinal support members and with the longitudinal support member detached from one of the upward support members.

FIG. 6 illustrates an isometric view of exercise apparatus 100 in the deployed configuration with weight plates separably coupled to longitudinal support members 102 and with longitudinal support members 102 coupled to upward support members 104. In one or more of the various embodiments, various weight-lifting exercises may be performed using apparatus 100 in the deployed configuration with weight plates separably coupled to longitudinal support members 102. For example, the user may employ apparatus to emulate a barbell by laying on the user's back with the user's chest positioned under lateral crossbeam 106 and with the user's spine being parallel to one or more longitudinal support members 102, gripping one or more handgrips 122 of lateral crossbeam 106, lifting apparatus 100 to perform bench press exercises.

FIG. 7 shows an isometric view of a portion of exercise apparatus 100 with weight plates separably coupled to one or more longitudinal support members 102 that are detached from one or more upward support members 104. In one or more of the various embodiments, with one or more longitudinal support members 102 separated from one or more upward support members 104, the user may employ one or more longitudinal support members 102 as a dumbbell to perform various weight-lifting exercises, such as curls, tricep extensions, or others.

Figure 8:
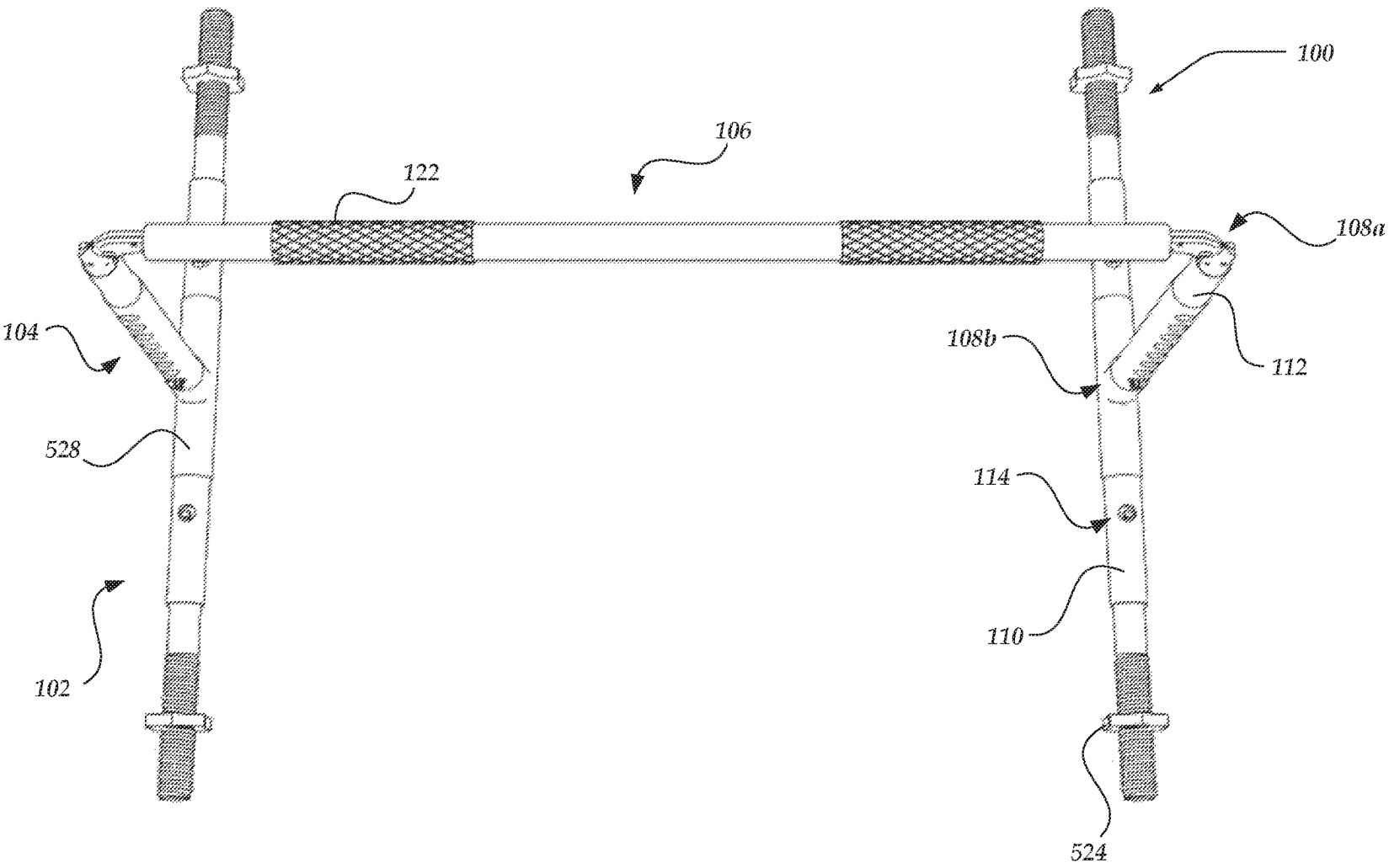
FIG. 8 illustrates an isometric view of the exercise apparatus of FIG. 1 with the apparatus in the deployed configuration and each of the support members in the shortened configuration.
Figure 9:
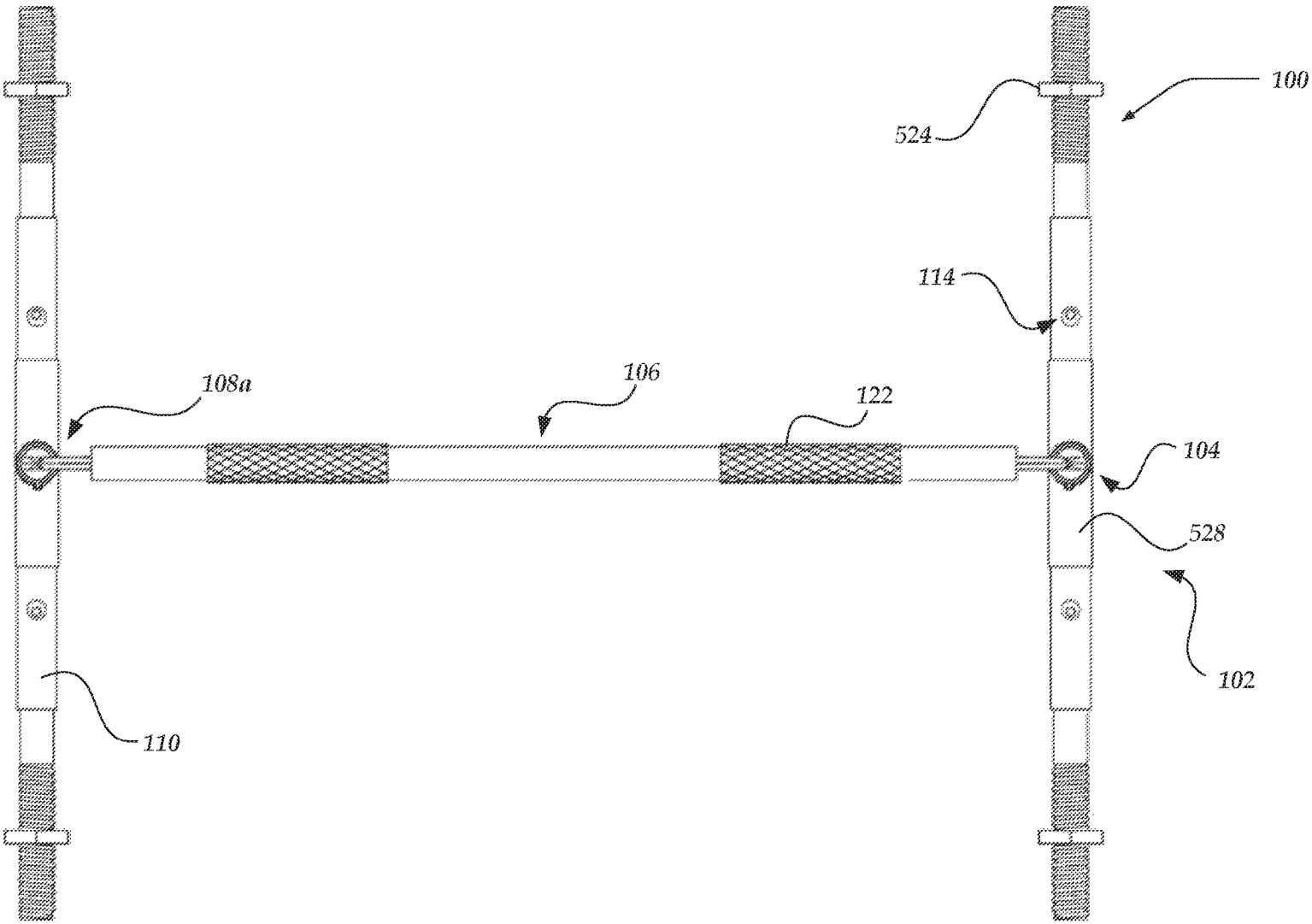
FIG. 9 shows an isometric view of the exercise apparatus of FIG. 1 with the apparatus in the deployed configuration and at least each of the longitudinal support members in the shortened configuration.

FIG. 8 illustrates an isometric view of exercise apparatus 100 with apparatus 100 in the deployed configuration and each of the support members in the shortened configuration. FIG. 9 shows an isometric view of exercise apparatus 100 with apparatus 100 in the deployed configuration and at least each longitudinal support member 102 in the shortened configuration. In one or more of the various embodiments, the user may grip one or more handgrips 122 in lateral crossbeam 106 and engage in various bodyweight exercises, such as seated dips, elevated pushups, modified pullups, crunches, side crunches, or others. In some of the various embodiments, the user may vary the height of one or more upward support members 104 to facilitate increasing or decreasing the difficulty of one or more exercises, changing the left-to-right balance of one or more exercises, or accommodating the user's height or body shape.

Figure 10:
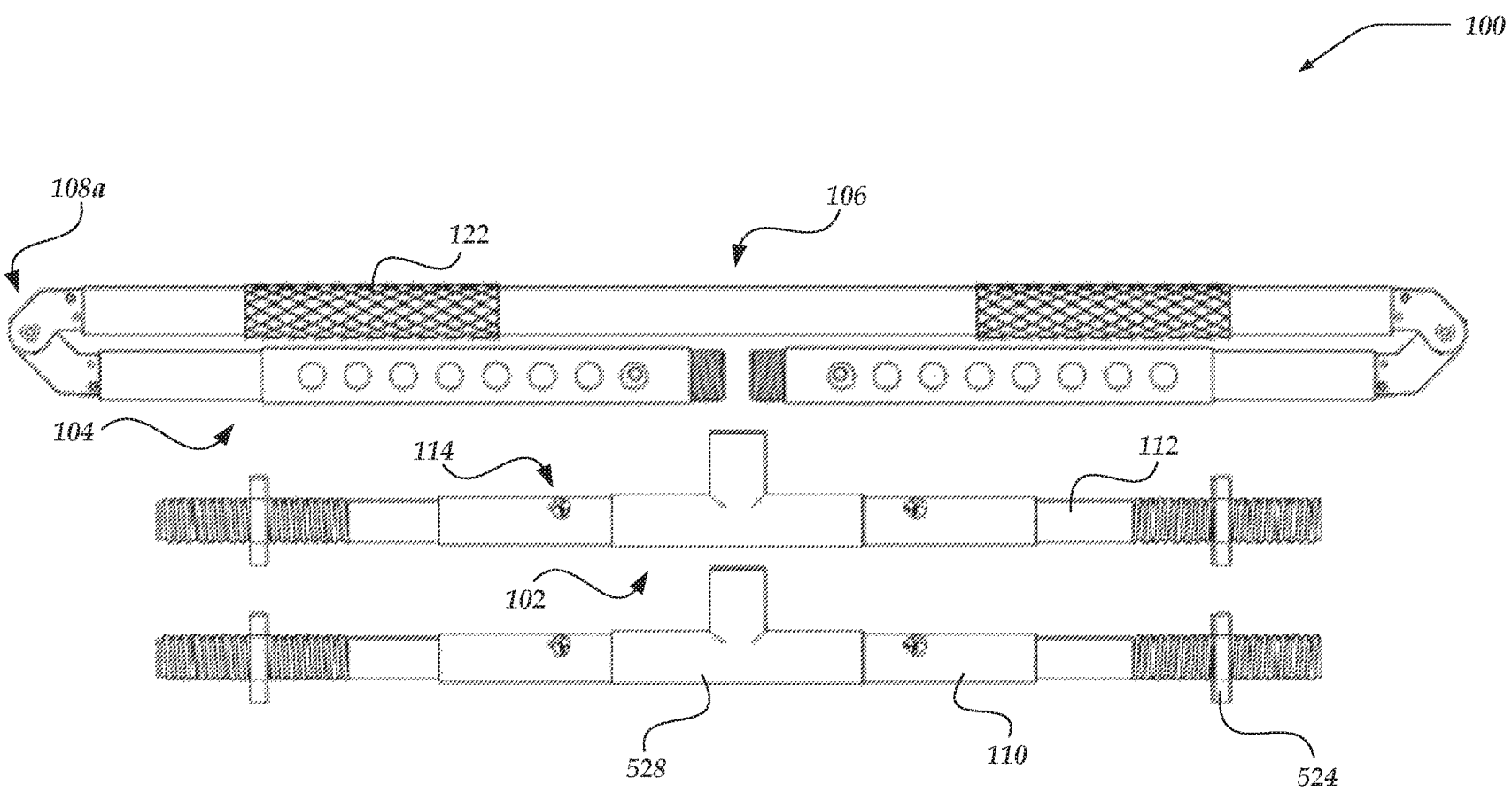
FIG. 10 illustrates an isometric view of the exercise apparatus of FIG. 1 with the apparatus in a collapsed configuration.

FIG. 10 illustrates an isometric view of exercise apparatus 100 with apparatus 100 in the collapsed configuration. In one or more of the various embodiments, one or more crossbeams 106 in the deployed configuration may have a length of 24, 26, 28, 30, 32, 34, 36, 38, 40, 42, 44, 46, 48, 50, or more inches. In some of the various embodiments, one or more upward support members 104 in the extended configuration may have a length of 24, 26, 28, 30, 32, 34, 36, 38, 40, 42, 44, 46, 48, 50, or more inches. In some embodiments, one or more longitudinal support members 102 in the extended configuration may have a length of 24, 26, 28, 30, 32, 34, 36, 38, 40, 42, 44, 46, 48, 50, or more inches. In some embodiments, one or more crossbeams 106 may include one or more telescoping tubes or may include one or more separable or hingable couplings 108 in a middle portion of one or more crossbeams 106, thereby facilitating decreasing the length of one or more crossbeams 106 in the collapsed configuration.

The terms "top," "bottom," "up," "down," and variants thereof are used consistently with respect to all elements and are defined relative to crossbeam 106 in the deployed configuration. The term "down" refers to the direction of a path from crossbeam 106 in the deployed configuration to the ground when the bottom surface of each longitudinal support member 102 engages the ground. The terms "proximal," "distal," and variants thereof are used consistently with respect to all elements and are defined relative to crossbeam 106. The term "proximal" refers to portions that are closer to crossbeam 106 in the deployed configuration, and the term "distal" refers to portions that are further from crossbeam 106 than the proximal portions in the deployed configuration. The terms "longitude," "lateral," "height," and variants thereof are also used consistently with respect to all elements and are defined relative to the lateral axis of crossbeam 106. The lateral axis of crossbeam 106 in the deployed configuration extends along the longitudinal center of crossbeam 106 from one end portion of crossbeam 106 to an opposite end portion of crossbeam 106. The longitudinal axis of longitudinal support member 102 is transverse to the lateral axis of crossbeam 106 and extends along the lateral center of longitudinal support member 102. The height of upward support member 104 in the deployed configuration is transverse to the longitudinal axis of longitudinal support member 102 and the lateral axis of crossbeam 106.

The foregoing examples should not be construed as limiting or exhaustive, yet rather, illustrative use cases to show implementations of at least one of the various embodiments of the invention. Accordingly, many changes can be made without departing from the spirit and scope of the invention. Thus, the scope of the invention is not limited by the disclosure of the examples. Instead, the invention should be determined entirely by reference to the claims that follow.

The embodiments of the invention in which an exclusive property or privilege is claimed are defined as follows:

1. An exercise equipment apparatus, comprising:

a lateral crossbeam;

a first upward support member having a proximal end portion and a distal end portion, the first upward support member coupling to the crossbeam;

a first longitudinal support member having two end portions, the first longitudinal support member separably coupling to the distal end portion of the first upward support member, each of the two end portions of the first longitudinal support member being sized and dimensioned to receive one or more first weight plates and facilitate use of the first longitudinal support member as a first weight-lifting bar when separated from the distal end portion of the first upward support member;

a second upward support member having a proximal end portion and a distal end portion, the crossbeam having a first end portion and a second end portion, the first upward support member coupling to the first end portion of the crossbeam, the second upward support member coupling to the second end portion of the crossbeam; and a second longitudinal support member having two end portions, the second longitudinal support member separably coupling to the distal end portion of the second upward support member, each of the two end portions of the second longitudinal support member being sized and dimensioned to receive one or more second weight plates and facilitate use of the second longitudinal support member as a second weight-lifting bar when separated from the distal end portion of the second upward support member.

2. The exercise equipment apparatus of claim 1, further comprising two collars coupling to respective ones of the end portions of the first longitudinal support member and securing the one or more first weight plates to the first longitudinal support member.

3. The exercise equipment apparatus of claim 1, wherein the two end portions of the first longitudinal support member are threaded and facilitate receiving one or more collars that secure the one or more first weight plates to the first longitudinal support member.

4. The exercise equipment apparatus of claim 1, wherein the first longitudinal support member has a middle portion disposed between the two end portions of the first longitudinal support member, the middle portion of the first longitudinal support member abutting one or more of the two end portions of the first longitudinal support member, the one or more of the two end portions of the first longitudinal support member having a first outer diameter, the middle portion of the first longitudinal support member having a second outer diameter that is larger than the first outer diameter of the one or more of the two end portions of the first longitudinal support member and that facilitates securing the one or more first weight plates between the middle portion and one or more collars received on the one or more of the two end portions of the first longitudinal support member.

5. The exercise equipment apparatus of claim 1, wherein the first longitudinal support member has one or more handgrips.

6. The exercise equipment apparatus of claim 1, wherein the first longitudinal support member has one or more telescoping tubes and one or more extension locks that, in an unlocked configuration, permit extending or shortening the one or more telescoping tubes and that, in a locked configuration, prevent extending or shortening the one or more telescoping tubes.

7. The exercise equipment apparatus of claim 1, wherein the first longitudinal support member has one or more telescoping tubes, each telescoping tube having an inner tube and an outer tube, the outer tube at least partially housing the inner tube, the inner tube having one or more handgrips.

8. The exercise equipment apparatus of claim 1, wherein the first upward support member has one or more telescoping tubes and one or more extension locks that, in an unlocked configuration, permit extending or shortening the one or more telescoping tubes and that, in a locked configuration, prevent extending or shortening the one or more telescoping tubes.

9. The exercise equipment apparatus of claim 1, wherein the lateral crossbeam has one or more handgrips.

10. An exercise equipment apparatus, comprising:

a lateral crossbeam;

a first upward support member having a proximal end portion and a distal end portion, the first upward support member coupling to the crossbeam; and a first longitudinal support member having two end portions, the first longitudinal support member separably coupling to the distal end portion of the first upward support member, each of the two end portions of the first longitudinal support member being sized and dimensioned to receive one or more weight plates and facilitate use of the first longitudinal support member as a weight-lifting bar when separated from the distal end portion of the first upward support member, wherein the first upward support member hingeably couples to the crossbeam and facilitates transitioning the exercise equipment apparatus between a deployed configuration and a collapsed configuration, the exercise equipment apparatus having a smaller form factor in the collapsed configuration.

11. The exercise equipment apparatus of claim 10, wherein the first longitudinal support member has one or more telescoping tubes and one or more extension locks that, in an unlocked configuration, permit extending or shortening the one or more telescoping tubes and that, in a locked configuration, prevent extending or shortening the one or more telescoping tubes.

12. The exercise equipment apparatus of claim 10, wherein the first longitudinal support member has one or more telescoping tubes, each telescoping tube having an inner tube and an outer tube, the outer tube at least partially housing the inner tube, the inner tube having one or more handgrips.

13. The exercise equipment apparatus of claim 10, wherein the first upward support member has one or more telescoping tubes and one or more extension locks that, in an unlocked configuration, permit extending or shortening the one or more telescoping tubes and that, in a locked configuration, prevent extending or shortening the one or more telescoping tubes.

14. The exercise equipment apparatus of claim 10, wherein the first longitudinal support member has one or more handgrips, and wherein the lateral crossbeam has one or more handgrips.

15. A method of exercising, comprising:

providing an exercise equipment apparatus, the exercise equipment apparatus comprising:

a lateral crossbeam;

a first upward support member having a proximal end portion and a distal end portion, the first upward support member coupling to the crossbeam; and a first longitudinal support member having two end portions, the first longitudinal support member separably coupling to the distal end portion of the first upward support member, each of the two end portions of the first longitudinal support member being sized and dimensioned to receive one or more weight plates and facilitate use of the first longitudinal support member as a weight-lifting bar when separated from the distal end portion of the first upward support member;

coupling the first longitudinal support member to the distal end portion of the first upward support member;

gripping the crossbeam with the first longitudinal support member coupled to the distal end portion of the first upward support member;

repeatedly pulling or pushing on the gripped crossbeam to repeatedly move a human body toward or away from the crossbeam with the first longitudinal support member coupled to the distal end portion of the first upward support member;

separating the first longitudinal support member from the distal end portion of the first upward support member;

coupling the one or more weight plates to the first longitudinal support member with the first longitudinal support member separated from the distal end portion of the first upward support member;

gripping the first longitudinal support member with the first longitudinal support member separated from the distal end portion of the first upward support member and with the one or more weight plates coupled to the first longitudinal support member; and repeatedly employing the gripped first longitudinal support member to perform one or more weight-lifting exercises with the first longitudinal support member separated from the distal end portion of the first upward support member and with the one or more weight plates coupled to the first longitudinal support member.

16. The method of claim 15, wherein the exercise equipment apparatus further comprises one or more collars that are sized and dimensioned to be received on one or more of the two end portions of the first longitudinal support member, the first longitudinal support member has a middle portion disposed between the two end portions of the first longitudinal support member, the middle portion of the first longitudinal support member abutting the one or more of the two end portions of the first longitudinal support member, the one or more of the two end portions of the first longitudinal support member having a first outer diameter, the middle portion of the first longitudinal support member having a second outer diameter that is larger than the first outer diameter of the one or more of the two end portions of the first longitudinal support member and that facilitates securing the one or more weight plates between the middle portion and the one or more collars received on the one or more of the two end portions of the first longitudinal support member, and coupling the one or more weight plates to the first longitudinal support member comprises:

sliding the one or more weight plates onto the one or more of the two end portions of the first longitudinal support member; and coupling the one or more collars to the one or more of the two end portions of the first longitudinal support member.

17. The method of claim 15, wherein the first longitudinal support member has one or more telescoping tubes and one or more extension locks that, in an unlocked configuration, permit extending or shortening the one or more telescoping tubes and that, in a locked configuration, prevent extending or shortening the one or more telescoping tubes, and repeatedly employing the gripped first longitudinal support member to perform the one or more weight-lifting exercises comprises:

repeatedly employing the gripped first longitudinal support member to perform the one or more weight-lifting exercises with the first longitudinal support member separated from the distal end portion of the first upward support member, with the one or more weight plates coupled to the first longitudinal support member, and with the one or more telescoping tubes fully extended.

18. The method of claim 15, wherein the first longitudinal support member has one or more telescoping tubes, each telescoping tube having an inner tube and an outer tube, the outer tube at least partially housing the inner tube, the inner tube having one or more handgrips, and gripping the first longitudinal support member comprises:

fully extending each telescoping tube to expose one or more portions of each handgrip;

gripping the first longitudinal support member with the first longitudinal support member separated from the distal end portion of the first upward support member, with the one or more weight plates coupled to the first longitudinal support member, and with each telescoping tube fully extended.

19. The method of claim 15, wherein the first upward support member has one or more telescoping tubes and one or more extension locks that, in an unlocked configuration, permit extending or shortening the one or more telescoping tubes and that, in a locked configuration, prevent extending or shortening the one or more telescoping tubes, and repeatedly pulling or pushing on the gripped crossbeam to repeatedly move the human body toward or away from the crossbeam comprises:

repeatedly pulling or pushing on the gripped crossbeam to repeatedly move the human body toward or away from the crossbeam with the first longitudinal support member coupled to the distal end portion of the first upward support member and with the one or more telescoping tubes fully extended.

20. The method of claim 15, wherein the first upward support member hingeably couples to the crossbeam and facilitates transitioning the exercise equipment apparatus between a deployed configuration and a collapsed configuration, the exercise equipment apparatus having a smaller form factor in the collapsed configuration, and repeatedly pulling or pushing on the gripped crossbeam to repeatedly move the human body toward or away from the crossbeam comprises:

transitioning the exercise equipment apparatus from the collapsed configuration to the deployed configuration; and repeatedly pulling or pushing on the gripped crossbeam to repeatedly move the human body toward or away from the crossbeam with the first longitudinal support member coupled to the distal end portion of the first upward support member and with the exercise equipment apparatus in the deployed configuration.

* * * * *